US010804065B2

(12) United States Patent
Takahashi

(10) Patent No.: US 10,804,065 B2
(45) Date of Patent: Oct. 13, 2020

(54) X-RAY TUBE

(71) Applicant: CANON ELECTRON TUBES & DEVICES CO., LTD., Otawara-shi (JP)

(72) Inventor: Naoki Takahashi, Nasushiobara (JP)

(73) Assignee: CANON ELECTRON TUBES & DEVICES CO., LTD., Otawara-shi (JP)

( * ) Notice: Subject to any disclaimer, the term of this patent is extended or adjusted under 35 U.S.C. 154(b) by 0 days.

(21) Appl. No.: 16/293,992

(22) Filed: Mar. 6, 2019

(65) Prior Publication Data

US 2019/0279836 A1 Sep. 12, 2019

(30) Foreign Application Priority Data

Mar. 7, 2018 (JP) ..... 2018-041201

(51) Int. Cl.

| | |
|---|---|
| ***H01J 35/18*** | (2006.01) |
| ***H01J 35/08*** | (2006.01) |
| ***H05G 1/02*** | (2006.01) |
| ***H01J 35/06*** | (2006.01) |

(52) U.S. Cl.

CPC ..... *H01J 35/18* (2013.01); *H01J 35/06* (2013.01); *H01J 35/08* (2013.01); *H05G 1/02* (2013.01); *H01J 35/186* (2019.05)

(58) Field of Classification Search

CPC .. H01J 35/08; H01J 35/18; H01J 35/06; H01J 35/186

See application file for complete search history.

(56) References Cited

U.S. PATENT DOCUMENTS

| | | | | |
|---|---|---|---|---|
| 4,928,297 | A | 5/1990 | Tsutsui et al. | |
| 2015/0162163 | A1* | 6/2015 | Anno | H01J 35/06 378/123 |
| 2016/0172149 | A1* | 6/2016 | Tezuka | H01J 35/06 378/137 |

FOREIGN PATENT DOCUMENTS

| | | |
|---|---|---|
| JP | 63-264043 | 10/1988 |
| JP | 2005-228696 | 5/2005 |

* cited by examiner

*Primary Examiner* — David P Porta
*Assistant Examiner* — Fani Boosalis
(74) *Attorney, Agent, or Firm* — Oblon, McClelland, Maier & Neustadt, L.L.P.

(57) ABSTRACT

According to one embodiment, an X-ray tube includes a vacuum envelope, a cathode, an anode, and an X-ray transmission assembly. The X-ray transmission assembly includes an X-ray transmission window and an X-ray tube attachment portion. The X-ray tube attachment portion includes a passage port to allow an available X-ray flux to pass therethrough and is opposed to an opening of the vacuum envelope. The passage port has a first shape of a rectangle, an ovally rounded rectangle or a corner-rounded rectangle. The first shape has a longer axis orthogonal to an X-ray tube axis.

4 Claims, 7 Drawing Sheets

X-RAY TUBE

CROSS-REFERENCE TO RELATED APPLICATIONS

This application is based upon and claims the benefit of priority from Japanese Patent Application No. 2018-041201, filed Mar. 7, 2018, the entire contents of which are incorporated herein by reference.

FIELD

Embodiments described herein relate generally to an X-ray tube.

BACKGROUND

In general, X-ray tubes are used in a medical diagnosis system, an industrial diagnosis system and the like. The X-ray tubes are used for, for example, X-ray object inspection or X-ray analysis executed in the industrial field and the like. The X-ray analysis implies component analysis of various materials and composition analysis of products. The X-ray tube employed for the X-ray analysis comprises an anode, a cathode, and a vacuum envelope. In addition, the X-ray tube comprises a beryllium (Be) window as an X-ray transmission window. The Be window serves as a part of the vacuum envelope and allows usable X-ray flux to be transmitted therethrough (takes out the available X-ray flux to the outside). The Be window can reduce an attenuation of X-rays as compared with a glass window. For example, since the Be window can suppress cut of soft X-rays, a subject of a light element can be captured with X-rays having small energy.

A cathode comprises a filament which emits electrons. The electrons emitted from the filament travel to an anode. Then, X-rays are emitted from a focal spot formed at the anode and transmitted through the X-ray transmission window. The available X-ray flux taken outside from the X-ray transmission window becomes a cone beam. An irradiation angle of the available X-ray flux is determined based on the shape of the opening portion of the X-ray transmission window, a geometric dimension from a focal spot position to the X-ray transmission window, and the like. The cone beam is used in a case of setting an inspected object between the X-ray tube and a detector (flat panel detector or image tube) similarly to general X-ray photography and capturing a range wider than the detection plane (i.e., a region where the X-rays can be detected) of the detector at one exposure.

Incidentally, the available X-ray flux is classified into the above-mentioned cone beam and a fan beam. The fan beam is suitable as the available X-ray flux for a line sensor capable of conveying an object to be measured, on a belt conveyor and executing sequential X-ray photography, similarly to baggage inspection or food inspection in an airport.

DETAILED DESCRIPTION

Figure 1:
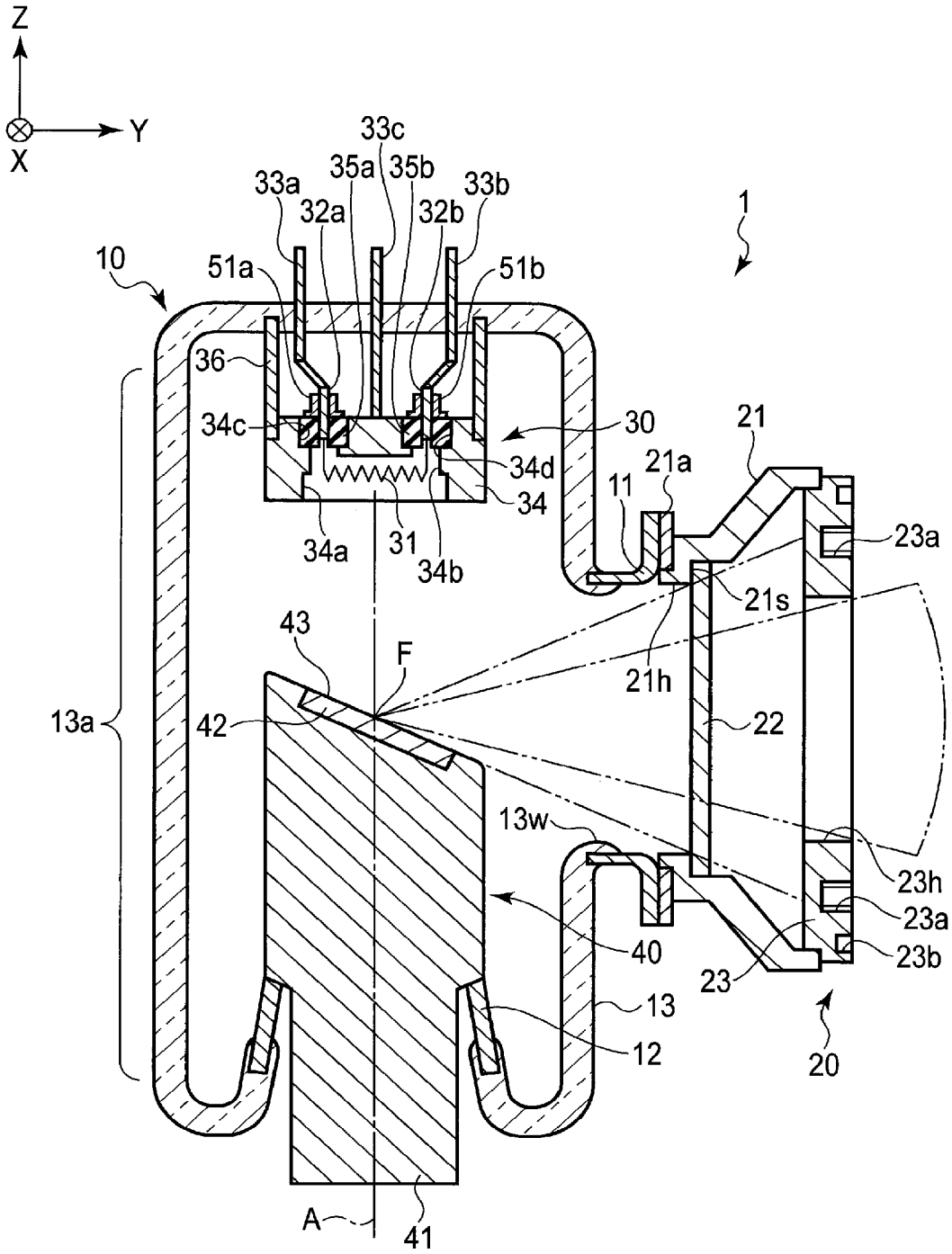
FIG. 1 is a cross-sectional view showing an X-ray tube according to an embodiment.

In general, according to one embodiment, there is provided an X-ray tube comprising: a vacuum envelope including an opening; a cathode contained in the vacuum envelope to emit electrons; an anode contained in the vacuum envelope to emit X-rays by collision of the electrons emitted from the cathode; and an X-ray transmission assembly which comprises an X-ray transmission window opposed to the opening, formed of beryllium, and allowing an available X-ray flux of the X-rays to be transmitted, and an X-ray tube attachment portion including a passage port to allow the available X-ray flux to pass therethrough and opposed to the opening, and which is attached airtightly to the vacuum envelope, wherein the passage port has a first shape of a rectangle, an ovally rounded rectangle or a corner-rounded rectangle, and the first shape has a longer axis orthogonal to an X-ray tube axis.

First, a basic concept of the embodiments will be explained.

A cone beam of an irradiation angle as large as possible is required as X-ray flux used for a non-destructive inspection. When a wide range is captured with an X-ray tube having a small irradiation angle, a distance between an X-ray tube and an inspected object needs to be made longer. In this case, inconvenience such as larger size of the X-ray device and a longer measurement time caused by reduction in X-ray dose may occur. Based on the above, increasing the distance between the X-ray tube and the inspected object is undesirable as a measure of making the irradiation range of the available X-ray flux wider. In addition, the irradiation angle of the available X-ray flux may be smaller or a lateral balance for a tube axis may be worse due to irregular dimensions of assembly of the X-ray tube or inclination and displacement of the X-ray transmission assembly and the tube axis. For this reason, designing the X-ray tube to include large margin in a calculated irradiation angle of the available X-ray flux is also required.

The irradiation angle of the available X-ray flux obtained from the X-ray tube is determined based on the dimensions of the opening portion of the X-ray transmission window and the distance between the focal spot and the X-ray transmission window. To make the irradiation angle larger, a measure of increasing the dimensions of the opening portion of the X-ray transmission window or a measure of reducing the distance between the focal spot and the X-ray transmission window may be employed. To make the opening portion of the X-ray transmission window larger, the dimensions of the X-ray transmission assembly including the X-ray transmission window and the flange portion need to be increased, which results in large size, heavy weight, and high price of the X-ray transmission assembly.

In contrast, to make the distance between the focal spot and the X-ray transmission window shorter, a measure of reducing a height dimension of the X-ray transmission window or a measure of displacing the orbit of the electron beam (off-center) from the X-ray tube axis may be employed. The height dimension of the X-ray transmission window is a dimension of the X-ray transmission window in the direction orthogonal to the X-ray tube axis. If the height of the X-ray transmission window is made lower, a problem that the withstand voltage is lowered occurs since the cathode and the anode are close to the X-ray transmission window (ground potential). In addition, since arranging the center axis of the cathode closely to the X-ray transmission window side from the X-ray tube axis shifts the coaxial positions of the vacuum envelope and the cathode, a problem that the withstand voltage is lower occurs due to an unbalanced electric field. In this case, the size of the X-ray tube may be made larger.

Furthermore, the focal spot position is considered to be closer to the X-ray transmission window side by inclining the center axis of the cathode from the X-ray tube axis. However, if the cathode is inclined, the distance between the focal spot and the X-ray transmission window is easily influenced by assembly dimensions of the cathode and the anode, which directly causes irregularity in irradiation angle. For this reason, a measure of inclining the cathode is an unrealistic measure.

Thus, in the embodiments, the X-ray tube capable of making the irradiation angle of the available X-ray flux larger can be obtained by employing a novel configuration of the X-ray transmission assembly.

According to the embodiments, (1) the distance between the X-ray tube and the measured object does not need to be long, (2) the X-ray tube is hardly influenced by irregularity in dimensions of assembly of the X-ray tube, (3) a situation of causing a larger size of the X-ray transmission assembly can be avoided, (4) the height dimension of the X-ray transmission window does not need to be low, (5) the cathode does not need to be disposed closely to the X-ray transmission window side, (6) the center axis of the cathode does not need to be inclined from the X-ray tube axis, and (7) a situation that the withstand voltage of the X-ray tube is lowered can be avoided.

Next, embodiments of means for embodying the above-explained basic concept will be explained with reference to the accompanying drawings. The disclosure is a mere example, and arbitrary change of gist which can be easily conceived by a person of ordinary skill in the art naturally falls within the inventive scope as long as the subject matter of the embodiments is maintained. To better clarify the explanations, the drawings may pictorially show width, thickness, shape, etc., of each portion as compared with an actual aspect, but they are mere examples and do not restrict the interpretation of the invention. In the present specification and drawings, after structural elements are each explained once with reference to the drawings, there is a case where their explanations will be omitted as appropriate, and those identical to or similar to the explained structural elements will be denoted by the same reference numbers, respectively, as the explained structural elements.

EMBODIMENT

First, an X-ray tube 1 according to an embodiment will be explained.

As shown in FIG. 1, a first direction X and a second direction Y are orthogonal to each other. A third direction Z is orthogonal to each of the first direction X and the second direction Y. The first direction X and the second direction Y may intersect at an angle other than 90 degrees. The X-ray tube 1 is a stationary anode X-ray tube. The X-ray tube 1 comprises a vacuum envelope 10, an X-ray transmission assembly 20, a cathode 30, and an anode 40.

The vacuum envelope 10 is formed of glass or a metal. In the embodiment, the vacuum envelope 10 is formed of a first metal vessel 11, a second metal vessel 12, and a glass vessel 13. The glass vessel 13 is formed of, for example, borosilicate glass. The glass vessel 13 can be formed by, for example, airtightly bonding glass members by welding. The glass vessel 13 is formed in a cylindrical shape with an end portion closed. The glass vessel 13 comprises a cylindrical portion 13*a*. The cylindrical portion 13*a* surrounds a containing portion 34, a target 42 and the like, which will be explained below. The cylindrical portion 13*a* (glass vessel 13) comprises an opening 13*w*. In the embodiment, the opening 13*w* has a circular shape. The opening 13*w* is located near a target surface 43, which will be explained below. Attenuation of dose of the available X-ray flux caused by the glass vessel 13 can be prevented by forming the opening 13*w*.

The first metal vessel 11 is located outside the glass vessel 13 and provided to surround the opening 13*w*. The first metal vessel 11 is, for example, formed of Kovar, in an annular shape. The first metal vessel 11 is connected airtightly to the glass vessel 13 by fusion. A flange portion is formed on the first metal vessel 11 so as to be coupled to the X-ray transmission assembly 20. In the embodiment, the first metal vessel 11 (flange portion) is formed in a shape of a circular frame.

The second metal vessel 12 is connected airtightly to the other end portion of the glass vessel 13 and an anode body 41, which will be explained below. The second metal vessel 12 is, for example, formed of Kovar, in an annular shape. The second metal vessel 12 is connected airtightly to the glass vessel 13 by fusion.

The vacuum envelope 10 is formed to contain the cathode 30, the anode 40, and the like and to partially expose the anode 40.

The X-ray transmission assembly 20 is attached to the first metal vessel 11 (vacuum envelope 10) to airtightly close the opening 13*w*. The vacuum envelope 10 is thereby hermetically sealed. The interior of the vacuum envelope 10 is kept evacuated.

The X-ray transmission assembly 20 comprises a window frame 21, a window frame flange portion 21*a*, an X-ray transmission window 22, and a flange portion 23.

The window frame 21 is opposed to the opening 13*w*. The window frame flange portion 21*a* is attached airtightly to the window frame 21 so as to be coupled to the first metal vessel 11. In the embodiment, the window frame 21 is formed in a shape of a conical frame. The window frame 21 is attached airtightly to the first metal vessel 11 (vacuum envelope 10).

The window frame 21 is formed of a metal, for example, copper. The window frame flange portion 21*a* is formed of a metal, for example, iron. In the embodiment, the window frame 21 and the window frame flange portion 21*a* are fixed by brazing. In the embodiment, the window frame flange portion 21*a* and the flange portion of the first metal vessel 11 are welded and the window frame 21 is thereby attached airtightly to the vacuum envelope 10.

The window frame 21 includes a through hole 21*h* and an attachment surface 21*s*. In the embodiment, the through hole 21*h* has a circular shape and the attachment surface 21*s* has a circular frame shape. The attachment surface 21*s* is flat. Attenuation and blocking of dose of the available X-ray flux caused by the window frame 21 can be prevented by forming the through hole 21*h*. The attachment surface 21*s* is formed outside the through hole 21*h* to form a part of the vacuum envelope 10.

The X-ray transmission window 22 allows X-rays to be transmitted and serves as a part of the vacuum envelope. The X-ray transmission window 22 can be formed of a material exhibiting an X-ray transmission property and having a high mechanical strength. In the embodiment, the X-ray transmission window 22 is formed of a Be plate (beryllium thin plate: thin plate formed of beryllium).

The X-ray transmission window 22 is formed in a flat plate shape. In the embodiment, the X-ray transmission window 22 is formed in a disk shape. The X-ray transmission window 22 includes an attachment region opposed to the attachment surface 21*s* and attached to the window frame 21, and an X-ray transmission region opposed to the through hole 21*h*. The X-ray transmission window 22 allows at least the available X-ray flux of X-rays to be transmitted.

The attachment region of the X-ray transmission window 22 is attached airtightly to the attachment surface 21*s*. For example, the X-ray transmission window 22 is brazed to the attachment surface 21*s* with a brazing member (not shown) and thereby attached to the window frame 21. Thus, the X-ray transmission window 22 can be contained in the window frame 21 and the airtight condition inside the window frame 21 and the vacuum envelope 10 can be maintained.

The flange portion 23 serving as the X-ray tube attachment portion is opposed to the opening 13*w*. In the embodiment, the flange portion 23 is formed in a circular frame shape. The flange portion 23 is located on a side opposite to the first metal vessel 11 with respect to the window frame 21 and attached airtightly to the window frame 21. The flange portion 23 is formed of a metal, for example, a stainless steel. In the embodiment, the flange portion 23 and the window frame 21 are brazed to each other and the flange portion 23 is thereby attached to the window frame 21.

The flange portion 23 includes a passage port 23*h* which allows the available X-ray flux to pass therethrough. The shape of the passage port 23*h* will be explained below. Attenuation and blocking of X-rays caused by the flange portion 23 can be prevented by forming the passage port 23*h*. Based on the above, the first metal vessel 11, the glass vessel 13, and the window frame 21 do not exist in the emission passage of X-rays which are allowed to be transmitted through the X-ray transmission window 22. The flange portion 23 allows the available X-ray flux of X-rays transmitted through the X-ray transmission window 22 to pass therethrough and blocks the X-rays other than the available X-ray flux.

The cathode 30 is contained in the vacuum envelope 10. The cathode 30 is disposed with a space to the anode 40 in the third direction Z along X-ray tube axis A. The cathode 30 comprises a filament 31 serving as an electron emission source, filament terminals 32*a* and 32*b*, cathode pins 33*a*, 33*b*, and 33*c*, the containing portion 34, insulating members 35*a* and 35*b*, and a support member 36.

The filament 31 emits electrons to the anode 40. In the embodiment, the filament 31 comprises a filament coil. The filament terminal 32*a* supports one of extending portions of the filament 31 and is electrically connected to the filament 31. The filament terminal 32*b* supports the other extending portion of the filament 31 and is electrically connected to the filament 31.

The cathode pins 33*a*, 33*b*, and 33*c* are conductive. In the embodiment, the cathode pins 33*a*, 33*b*, and 33*c* are formed in a metal rod shape. The cathode pins 33*a*, 33*b*, and 33*c* are attached to the glass vessel 13. The cathode pins 33*a*, 33*b*, and 33*c* are connected airtightly to the glass vessel 13 by fusion. Each of the cathode pins 33*a*, 33*b*, and 33*c* has an end portion located outside the vacuum envelope 10. The cathode pin 33*a* is electrically connected to the filament terminal 32*a*, the cathode pin 33*b* is electrically connected to the filament terminal 32*b*, and the cathode pin 33*c* is electrically connected to the containing portion 34.

The containing portion 34 is shaped in a columnar shape. The containing portion 34 comprises a converging groove 34*a* and a containing groove 34*b*. The converging groove 34*a* opens to the anode 40 side and comprises a function of converging the electrons. The containing grove 34*b* is formed on a bottom surface of the converging groove 34*a*, opens to the anode 40 side, and contains the filament 31.

In addition, the containing portion 34 also comprises a through hole 34*c* through which the filament terminal 32*a* passes, and a through hole 34*d* through which the filament terminal 32*b* passes.

The insulating member 35*a* is provided in the through hole 34*c* and fixed to the containing portion 34. The insulating member 35*a* is formed in a tubular shape, and the filament terminal 32*a* is inserted into the insulating member 35*a*. The filament terminal 32*a* is in contact with a connection component (sleeve) 51*a* fixed to the insulating member 35*a*.

The insulating member 35*b* is provided in the through hole 34*d* and fixed to the containing portion 34. The insulating member 35*b* is formed in a tubular shape, and the filament terminal 32*b* is inserted into the insulating member 35*b*. The filament terminal 32*b* is in contact with a connection component (sleeve) 51*b* fixed to the insulating member 35*b*.

Based on the above, the filament 31 is electrically insulated from the containing portion 34.

The support member 36 is fixed to the vacuum envelope 10 to support the containing portion 34. For this reason, the containing portion 34 is fixed to the vacuum envelope 10. The support member 36 is formed of a glass sealing metal. The support member 36 is fixed to the glass vessel 13 by glass fusion. In the embodiment, the support member 36 is formed of Kovar.

The anode 40 is contained in the vacuum envelope 10. The anode 40 comprises the anode body 41, and the target 42 provided at a position of an end surface on the cathode 30 side, of the anode body 41. The anode body 41 is formed in a columnar shape. The anode body 41 is formed of a metal of high heat conductivity such as copper and a copper alloy.

The target 42 is formed in a disk shape. The target 42 is formed of a high melting point metal such as tungsten (W) and a tungsten alloy. The target 42 includes the target surface 43 on the side opposite to the cathode 30. The focal spot F where the electrons emitted from the filament 31 collide with the target surface 43 and emits X-rays is formed on the target surface 43.

The second metal vessel 12 is airtightly fixed to the anode body 41. The second metal vessel 12 is airtightly connected to the anode body 41 by brazing.

Next, the X-ray tube 1 will be explained particularly with respect to the flange portion 23.

Figure 2:
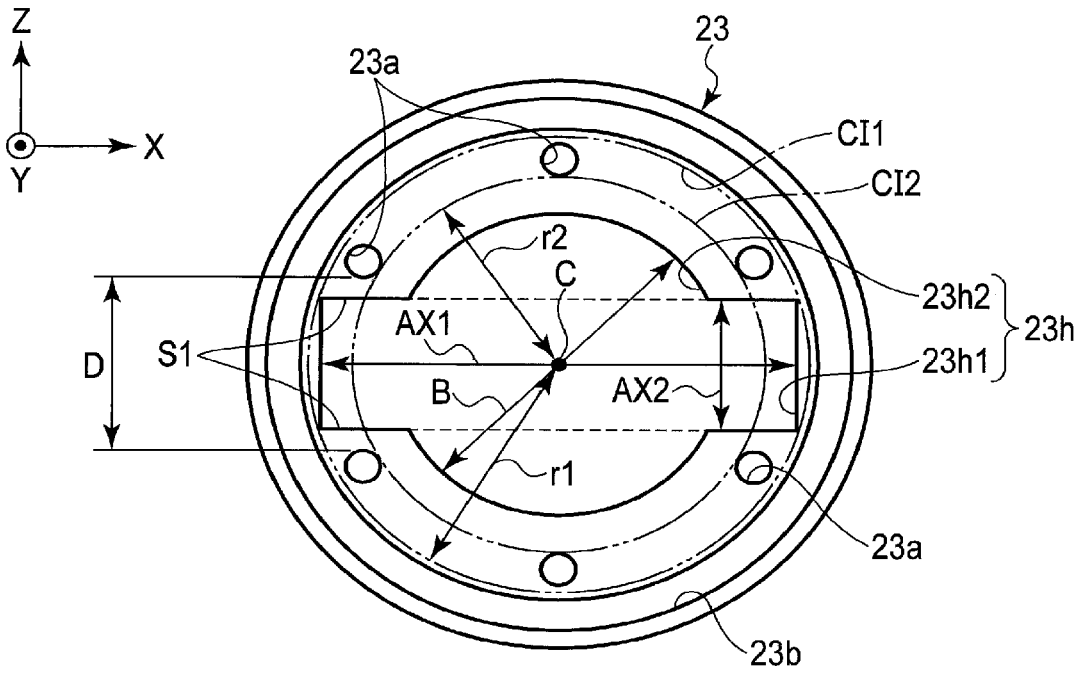
FIG. 2 is a plan view showing a flange portion shown in FIG. 1.

As shown in FIG. 1 and FIG. 2, the passage port 23*h* has at least a rectangular first shape 23*h*1. In the embodiment, the passage port 23*h* has a shape obtained by overlaying the first shape 23*h*1 and a circular second shape 23*h*2. The first shape 23*h*1 has a longer axis AX1 orthogonal to the X-ray tube axis A and a shorter axis AX2 parallel to the X-ray tube axis A. The first shape 23*h*1 has two sides S1 parallel to the longer axis AX1. Diameter B of the second shape 23*h*2 is shorter than the longer axis AX1 and longer than the shorter axis AX2. The second shape 23*h*2 intersects two sides S1.

The flange portion 23 includes screw holes 23*a* and an annular containing groove 23*b*. For example, when the X-ray tube 1 is contained in a housing (not shown) and fixed to the housing, the X-ray tube 1 can be fixed to the housing by screws using the screw holes 23*a*. If an O-ring (not shown) is contained in the containing groove 23*b*, the O-ring can seal the gap between the flange portion 23 and the housing. For example, if a coolant exists in space between the housing and the X-ray tube 1, the O-ring can suppress leakage of the coolant. Besides, a portion where the coolant may leak may be sealed appropriately. For example, the window frame 21 is further attached liquid-tightly to the first metal vessel 11 and the flange portion 23 is further attached liquid-tightly to the window frame 21.

The screw holes 23*a* are located on a single circle outside the passage port 23*h*. The single circle is a circle about center axis C of the flange portion 23. In the embodiment, the center axis C is parallel to the second direction Y. Radius r1 of circumscribed circle CI1 of the first shape 23*h*1 is larger than radius r2 of inscribed circle CI2 of the screw holes 23*a*. The circumscribed circle CI1 and the inscribed circle CI2 are concentric circles having the center axis C at their centers.

The number of screw holes 23*a* is desirably six or less from the viewpoint of securing the region occupied by the first shape 23*h*1 of the passage port 23*h*. However, the number of screw holes 23*a* may be seven or more. In this case, the screw holes 23*a* are concentrated in a region outside the region occupied by the first shape 23*h*1.

In the embodiment, the number of screw holes 23*a* is six. The screw holes 23*a* are located in the single circle and spaced apart with regular intervals. Distance in a straight line D between a pair of adjacent screw holes 23*a* is longer than the shorter axis AX2 of the first shape 23*h*1. The region occupied by the first shape 23*h*1 can be secured even if the screw holes 23*a* are provided at regular intervals. In addition, since uniforming the stress applied to the O-ring contained in the containing groove 23*b* can be attempted, leakage of the coolant caused by the O-ring can be further suppressed as compared with a case where six screw holes 23*a* are not located at regular intervals.

Next, the available X-ray flux emitted from the X-ray tube 1 of the embodiment will be explained. Outline E of the available X-ray flux in a case where the available X-ray flux emitted from the X-ray tube 1 is projected to a virtual projection plane P will be explained.

Figure 3:
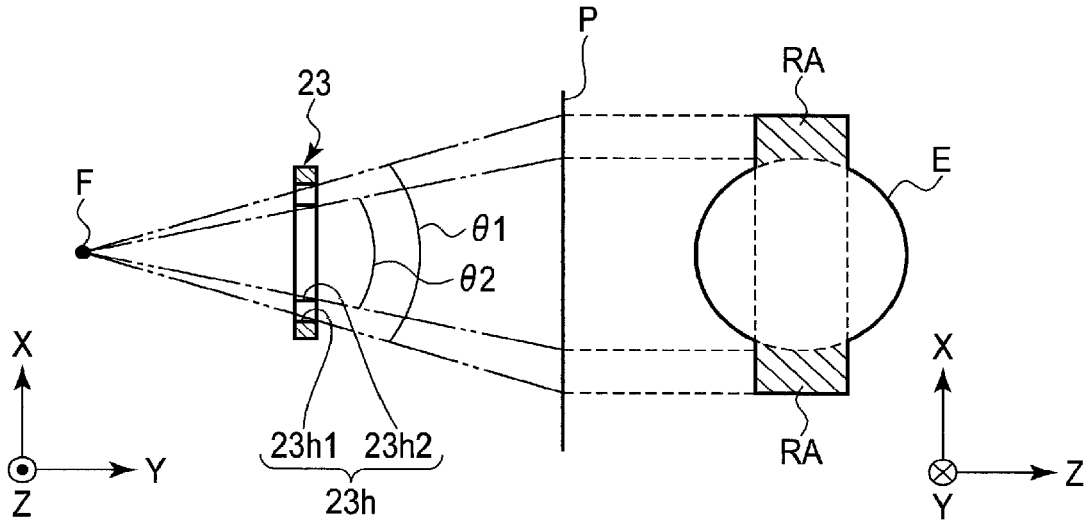
FIG. 3 is a cross-sectional view showing the flange portion, for explanation of the available X-ray flux passing through a passage port of the flange portion.

As shown in FIG. 3, the projection plane P is a plane parallel to the X-Z plane. The outline E of the available X-ray flux has a shape corresponding to the shape of the passage port 23*h*. The outline E is shown in a state of watching the projection plane P in planar view (from the second direction Y). Region RA is included in a range surrounded by the outline E. The region RA is a range excluding the irradiation range of the X-rays passing through the second shape 23*h*2, of the irradiation range of the X-rays passing through the first shape 23*h*1. In the drawing, hatch lines are drawn in the region RA.

For this reason, the range of irradiation of the available X-ray flux in the first direction X can be made larger in accordance with the region RA. When the irradiation angle of the available X-ray flux on the X-Y plane is noticed, irradiation angle θ1 of X-rays passing through the first shape 23*h*1 is larger than irradiation angle θ2 of X-rays passing through the second shape 23*h*2. For this reason, the irradiation angle of the available X-ray flux can be made larger as compared with a case where the passage port 23*h* does not include the first shape 23*h*1.

According to the X-ray tube 1 of the above-constituted embodiments, the X-ray tube 1 comprises the vacuum envelope 10, the X-ray transmission assembly 20, the cathode 30, and the anode 40. The X-ray transmission assembly 20 comprises the X-ray transmission window 22, and the flange portion 23 serving as the X-ray tube attachment portion. The passage port 23*h* of the flange portion 23 has the rectangular first shape 23*h*1, and the first shape 23*h*1 has the longer axis AX1 orthogonal to the X-ray tube axis A. The flange portion 23 can make the irradiation angle θ1 of the available X-ray flux (fan beam) larger, in the first direction X perpendicular to the X-ray tube axis A.

If the inspected object conveyed by a belt conveyor is captured with the available X-ray flux (fan beam) emitted from the X-ray tube 1 similarly to the baggage inspection and the food inspection, the distance between the X-ray tube 1 and the inspected object can be made smaller as the irradiation angle θ1 is larger. For this reason, the capturing period can be shortened by capturing the inspected object using the X-ray tube 1 of the embodiments.

In addition, a portion to make the irradiation angle of the available X-ray flux larger does not need to be optionally added to the X-ray tube 1. Since the increase in manufacturing costs of the X-ray tube 1 can be suppressed, increase in the product price of the X-ray tube 1 can be suppressed.

Since the irradiation angle of the available X-ray flux is made larger, the size of the X-ray transmission assembly 20 does not need to be made larger. For this reason, the increase in size and weight of the X-ray transmission assembly 20 can be suppressed.

Furthermore, a withstand voltage of the X-ray tube 1 cannot be lowered even if the passage port 23*h* has the first shape 23*h*1. For this reason, a situation where the withstand voltage of the X-ray tube 1 becomes lower can be avoided.

The X-ray tube 1 capable of making the irradiation angle of the available X-ray flux larger can be obtained based on the above matters.

Modified Example 1

Next, the X-ray tube 1 according to modified example 1 of the embodiment will be explained.

Figure 4:
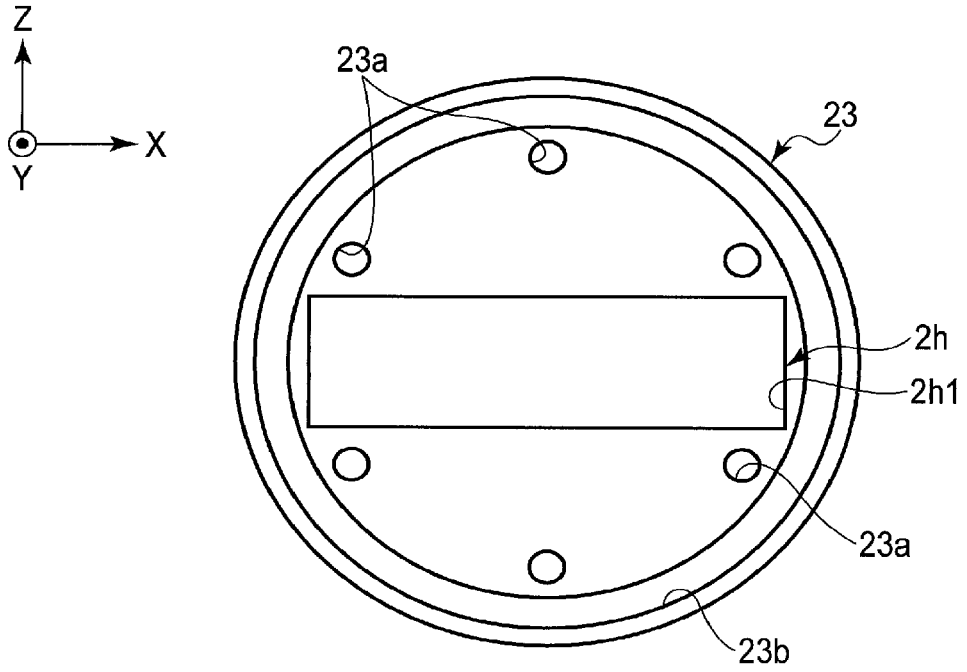
FIG. 4 is a plan view showing the flange portion of the X-ray tube according to modified example 1 of the embodiment.

As shown in FIG. 4, the X-ray tube 1 of the modified example 1 is configured similarly to the X-ray tube of the embodiment except for the shape of the passage port 23*h*. The passage port 23*h* of the modified example 1 has the first shape 23*h*1 but does not have the second shape 23*h*2.

Next, the available X-ray flux emitted from the X-ray tube 1 of the modified example 1 will be explained. Outline E of the available X-ray flux in a case where the available X-ray flux emitted from the X-ray tube 1 is projected to the projection plane P will also be explained in this example.

Figure 5:
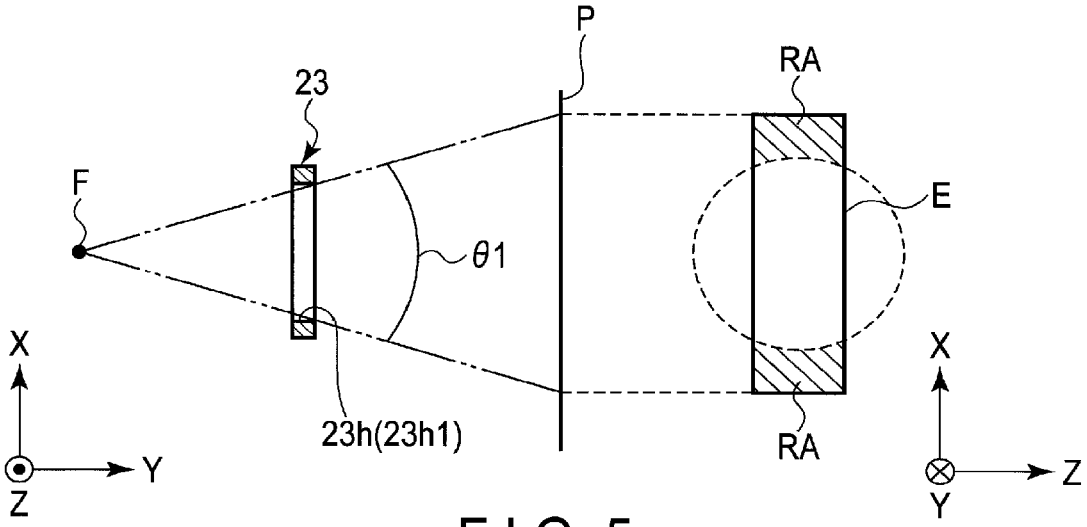
FIG. 5 is a cross-sectional view showing the flange portion shown in FIG. 4, for explanation of the available X-ray flux passing through a passage port of the flange portion.

As shown in FIG. 5, the outline E of the available X-ray flux has a shape corresponding to the first shape 23*h*1. In the modified example 1, too, the region RA is included in a range surrounded by the outline E similarly to the above embodiment. For this reason, the X-ray tube 1 capable of emitting the available X-ray flux of the large irradiation angle θ1 can be obtained.

In modified example 1, too, the same advantages as those of the embodiment can be obtained, based on the above matters.

Modified Example 2

Next, the X-ray tube 1 according to modified example 2 of the embodiment will be explained.

Figure 6:
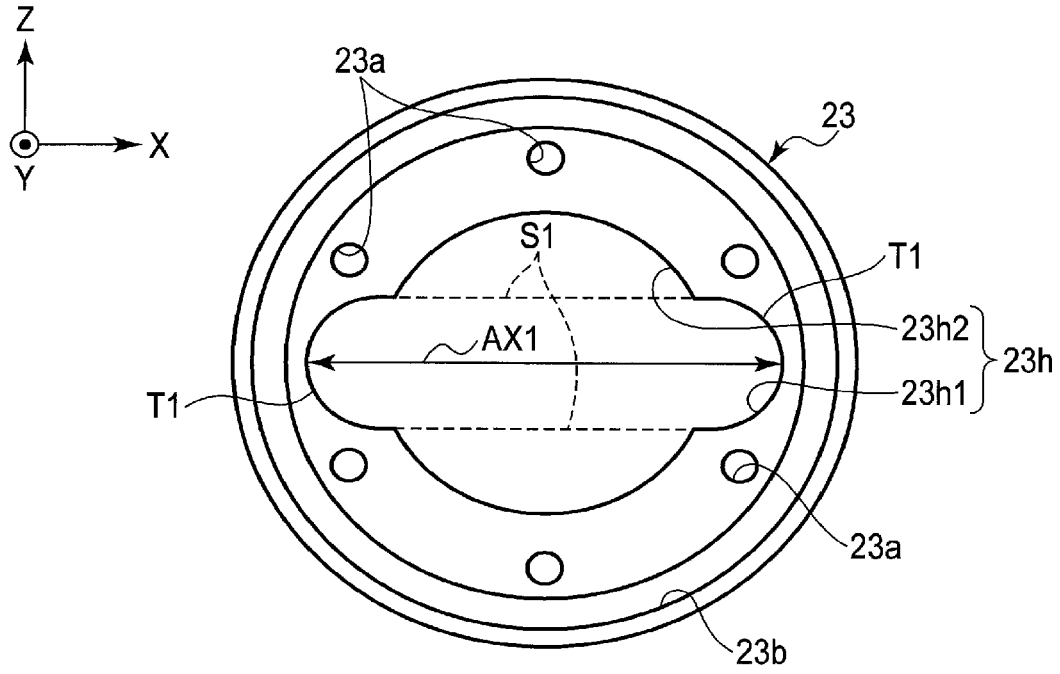
FIG. 6 is a plan view showing the flange portion of the X-ray tube according to modified example 2 of the embodiment.

As shown in FIG. 6, the X-ray tube 1 of the modified example 2 is configured similarly to the X-ray tube of the embodiment except for the shape of the passage port 23*h*. The passage port 23*h* of the modified example 2 has the first shape 23*h*1 of an ovally rounded rectangle. The ovally rounded rectangle of the modified example 2 has two sides S1 that are equal in length and are parallel to the longer axis AX1, and two semicircles T1 equal in radius. The first shape 23*h*1 may not be rectangular like the modified example 2. In modified example 2, too, the same advantages as those of the embodiment can be obtained.

Modified Example 3

Next, the X-ray tube 1 according to modified example 3 of the embodiment will be explained.

Figure 7:
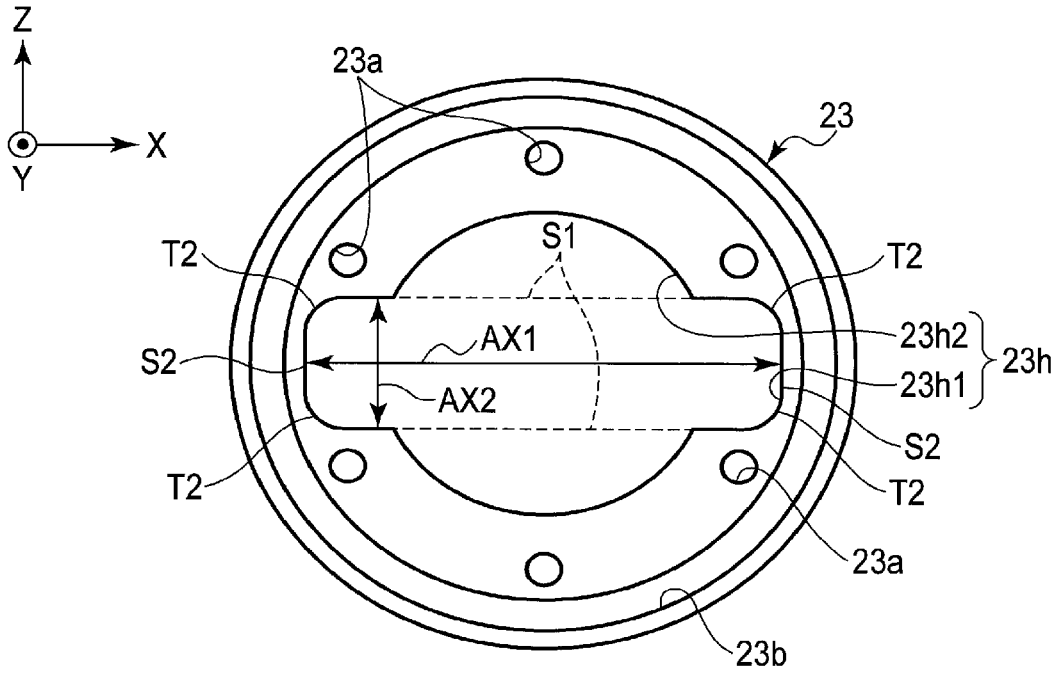
FIG. 7 is a plan view showing the flange portion of the X-ray tube according to modified example 3 of the embodiment.

As shown in FIG. 7, the X-ray tube 1 of the modified example 3 is configured similarly to the X-ray tube of the embodiment except for the shape of the passage port 23*h*. The passage port 23*h* of the modified example 3 has the first shape 23*h*1 having a corner-rounded rectangle. The corner-rounded rectangle has two sides S1 parallel to the longer axis AX1, two sides S2 parallel to the shorter axis AX2, and four arcs T2. In the modified example 3, two sides S1 are equal in length, two sides S2 are equal in length, and four arcs T2 are equal in radius. Unlike the modified example 3, however, two sides S1 may not be equal in length, two sides S2 may not be equal in length, and four arcs T2 may not be equal in radius.

In modified example 3, too, the same advantages as those of the embodiment can be obtained.

Modified Example 4

Next, the X-ray tube 1 according to modified example 4 of the embodiment will be explained.

Figure 8:
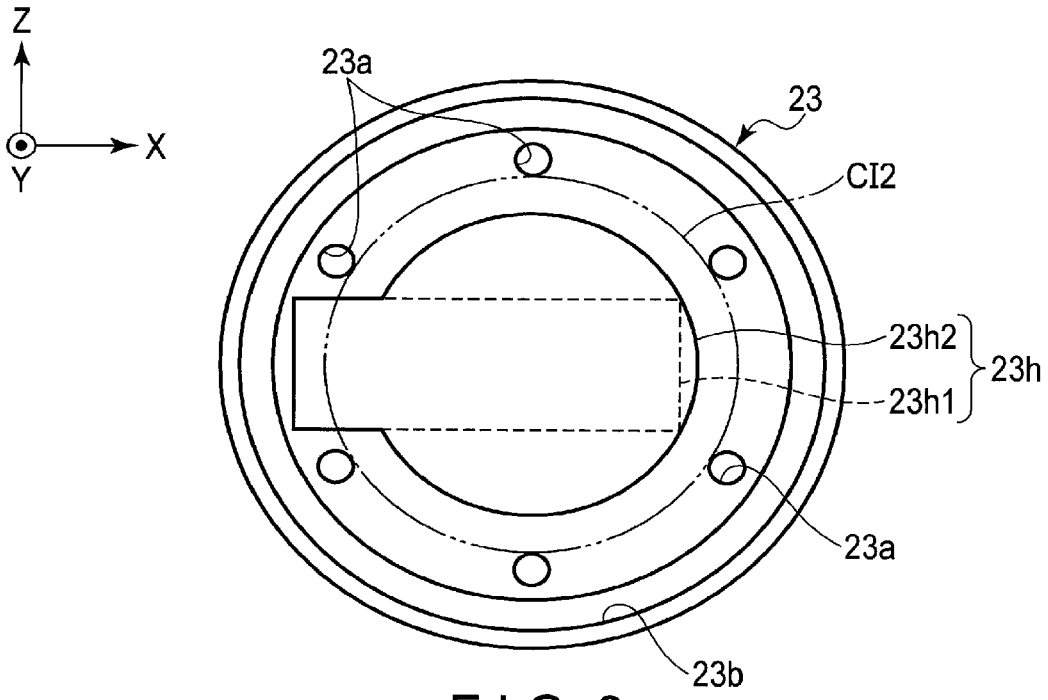
FIG. 8 is a plan view showing the flange portion of the X-ray tube according to modified example 4 of the embodiment.

As shown in FIG. 8, the X-ray tube 1 of the modified example 4 is configured similarly to the X-ray tube of the embodiment except for the shape of the passage port 23*h*. The first shape 23*h*1 may intersect the inscribed circle CI2 of the screw holes 23*a* at one position. The first shape 23*h*1 of the embodiment intersects the inscribed circle CI2 at two positions (FIG. 2).

In modified example 4, too, the same advantages as those of the embodiment can be obtained.

Comparative Example 1

Next, the X-ray tube 1 according to comparative example 1 will be explained.

Figure 9:
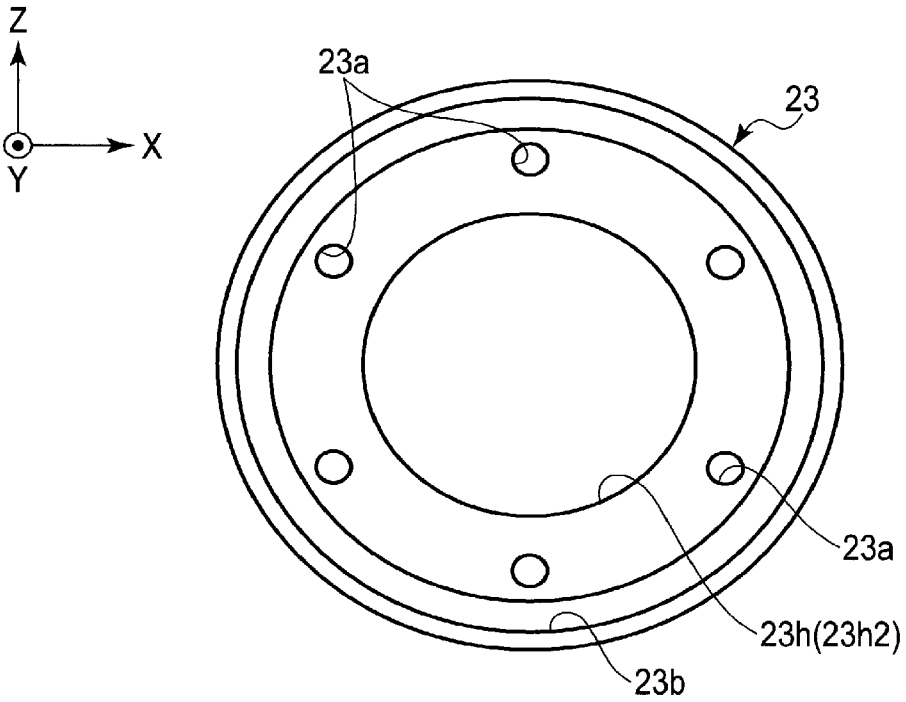
FIG. 9 is a plan view showing the flange portion of the X-ray tube according to comparative example 1.

As shown in FIG. 9, the X-ray tube 1 of the comparative example 1 is configured similarly to the X-ray tube of the embodiment except for the shape of the passage port 23*h*. The passage port 23*h* of the comparative example 1 has the second shape 23*h*2 but does not have the first shape 23*h*1. The flange portion 23 blocks the X-rays other than the available X-ray flux passing through the passage port 23*h*. The available X-ray flux emitted from the X-ray tube 1 of the comparative example 1 becomes a cone beam. The irradiation angle θ2 of the available X-ray flux of the comparative example 1 is smaller than the above-explained irradiation angle θ1 of the embodiment.

Based on the above matters, making the irradiation angle of the available X-ray flux larger is difficult in the X-ray tube 1 of the comparative example 1.

Comparative Example 2

Next, the X-ray tube 1 according to comparative example 2 will be explained. The X-ray tube 1 of the comparative example 2 is configured similarly to the X-ray tube of the embodiment except for the configuration of the anode 40 and the shape of the passage port 23*h*.

Figure 10:
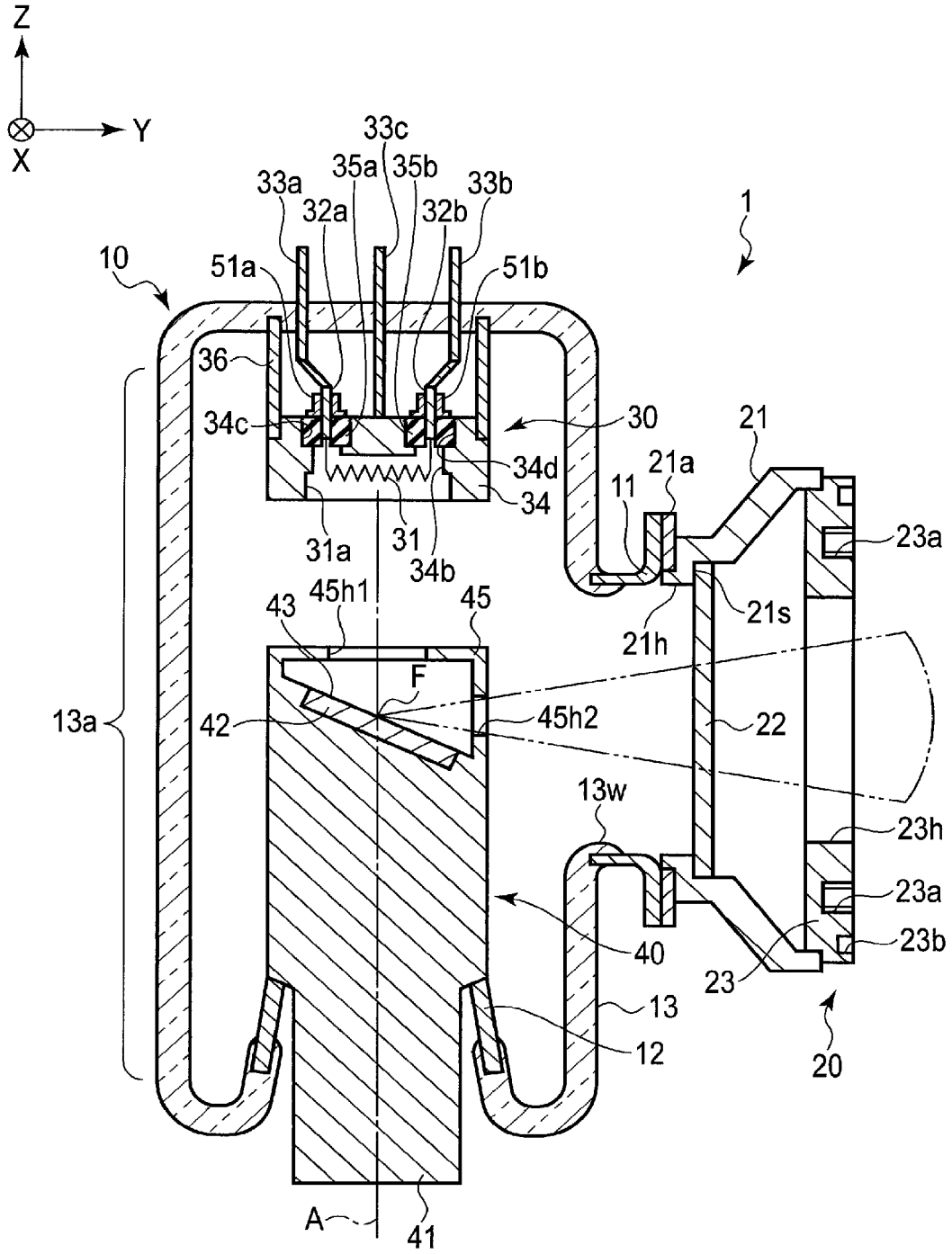
FIG. 10 is a cross-sectional view showing the X-ray tube according to comparative example 2.

As shown in FIG. 10, the anode 40 further comprises an anode hood 45. The anode hood 45 covers the target surface 43. The anode hood 45 is connected physically and electrically to the anode body 41. For example, the anode hood 45 is formed of the same material as the material to form the anode body 41 and is fixed to the anode body 41 by brazing or the like. The anode hood 45 comprises an intake port 45*h*1 and a passage port 45*h*2. The intake port 45*h*1 surrounds an orbit of electrons flowing from the filament 31 to the target surface 43.

The anode hood 45 blocks X-rays emitted from focal spot F. Thus, the rectangular passage port 45*h*2 is formed in the anode hood 45. The available X-ray flux passing through the passage port 45*h*2 becomes a fan beam, which is transmitted through the X-ray transmission window 22. For this reason, the available X-ray flux which has passed through the passage port 45*h*2 and is to pass through the passage port 23*h* can obtain the irradiation angle (irradiation angle θ1) equal to that in the embodiment on the X-Y plane.

Figure 11:
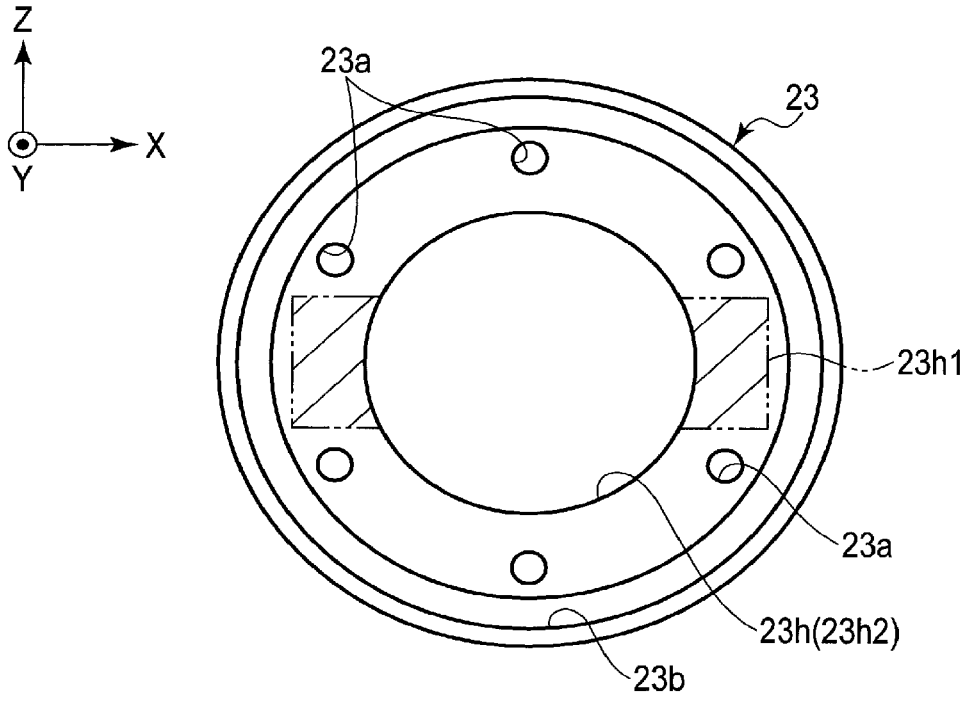
FIG. 11 is a plan view showing the flange portion shown in FIG. 10, for explanation of the available X-ray flux passing through a passage port of the flange portion.

As shown in FIG. 11, the passage port 23*h* of the comparative example 2 has the second shape 23*h*2 but does not have the first shape 23*h*1. The available X-ray flux emitted from the X-ray tube 1 of the comparative example 2 becomes a fan beam, but irradiation angle θ2 of the available X-ray flux is smaller than irradiation angle θ1 of the embodiment. Based on the above matters, making the irradiation angle of the available X-ray flux larger is also difficult in the X-ray tube 1 of the comparative example 2.

In addition, in the comparative example 2, the X-ray tube 1 requires the anode hood 45 to use the available X-ray flux as the fan beam. In the comparative example 2, since suppressing the increase in manufacturing costs of the X-ray tube 1 is difficult, suppressing the increase in the product price of the X-ray tube 1 is difficult.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An X-ray tube comprising:

a vacuum envelope including an opening;

a cathode contained in the vacuum envelope to emit electrons;

an anode contained in the vacuum envelope to emit X-rays by collision of the electrons emitted from the cathode; and an X-ray transmission assembly which comprises an X-ray transmission window opposed to the opening, formed of beryllium, and allowing an available X-ray flux of the X-rays to be transmitted, and an X-ray tube attachment portion including a passage port to allow the available X-ray flux to pass therethrough and opposed to the opening, and which is attached airtightly to the vacuum envelope, wherein the passage port has a first shape of a rectangle, an ovally rounded rectangle or a corner-rounded rectangle, the first shape has a longer axis orthogonal to an X-ray tube axis, the X-ray tube attachment portion includes six screw holes located on a same circle outside the passage port, a radius of a circumscribed circle of the first shape is larger than a radius of an inscribed circle of the screw holes, the screw holes are located at regular intervals on the same circle, the first shape has a shorter axis parallel to the X-ray tube axis, and a distance in straight line between a pair of adjacent screw holes is longer than the shorter axis.

2. The X-ray tube of claim 1, wherein the passage port has a shape in which the first shape and a circular second shape overlap, and a diameter of the second shape is shorter than the longer axis and longer than the shorter axis.

3. The X-ray tube of claim 1, wherein the first shape has two sides parallel to the longer axis, the passage port has a shape in which the first shape and a circular second shape overlap, and the second shape intersects the sides.

4. The X-ray tube of claim 1, wherein the circumscribed circle and the inscribed circle are concentric circles.

* * * * *